United States Patent [19]

Chabert

[11] Patent Number: 5,038,774

[45] Date of Patent: Aug. 13, 1991

[54] PROCESS AND EXPANDER FOR SUPPLYING RESPIRATORY GAS TO AN UNDERWATER DIVER

[75] Inventor: Jean-Marie Chabert, Valbonne, France

[73] Assignee: La Spirotechnique Industrielle et Commerciale, Carros Cedex, France

[21] Appl. No.: 524,964

[22] Filed: May 18, 1990

[30] Foreign Application Priority Data

May 18, 1989 [FR] France ..... 8906470

[51] Int. Cl.[5] ..... A62B 09/02

[52] U.S. Cl. ..... 128/205.24; 128/204.26; 137/908

[58] Field of Search ..... 128/204.26, 205.24, 128/201.27, 204.29; 137/494, DIG. 908

[56] References Cited

U.S. PATENT DOCUMENTS

| | | | |
|---|---|---|---|
| 3,045,688 | 7/1962 | Fay | 137/908 X |
| 3,358,681 | 12/1967 | Chabanier | 128/204.29 |
| 3,920,033 | 11/1975 | Ferrando | 137/908 X |
| 3,952,773 | 4/1976 | Hahn | 137/908 X |
| 4,192,298 | 3/1980 | Ferraro et al. | 128/205.24 |
| 4,219,017 | 8/1980 | Shamlian et al. | 128/204.26 |
| 4,266,538 | 5/1981 | Ruchti | 128/204.26 |
| 4,289,126 | 9/1981 | Seireg et al. . | |
| 4,450,837 | 5/1984 | Ream | 128/201.27 |
| 4,503,852 | 3/1985 | Christianson | 128/204.26 |
| 4,856,507 | 8/1989 | Ouillon et al. | 128/204.26 |
| 4,971,108 | 11/1990 | Gottlieb | 137/495 |

FOREIGN PATENT DOCUMENTS

| | | |
|---|---|---|
| 0276676 | 8/1988 | European Pat. Off. . |
| 2040171 | 8/1980 | United Kingdom . |

*Primary Examiner*—Clifford D. Crowder
*Assistant Examiner*—Eric P. Raciti
*Attorney, Agent, or Firm*—Young & Thompson

[57] ABSTRACT

An expander for compressed gas of the type having a valve 12, 13 delivering an expanded gas at 50 from a high pressure gas 6, 7, and a pilot expander 21 delivering via 41 a gaseous control charge into the compartment 17 of the principal expander. Useful in delivering respiratory gas in underwater diving.

4 Claims, 1 Drawing Sheet

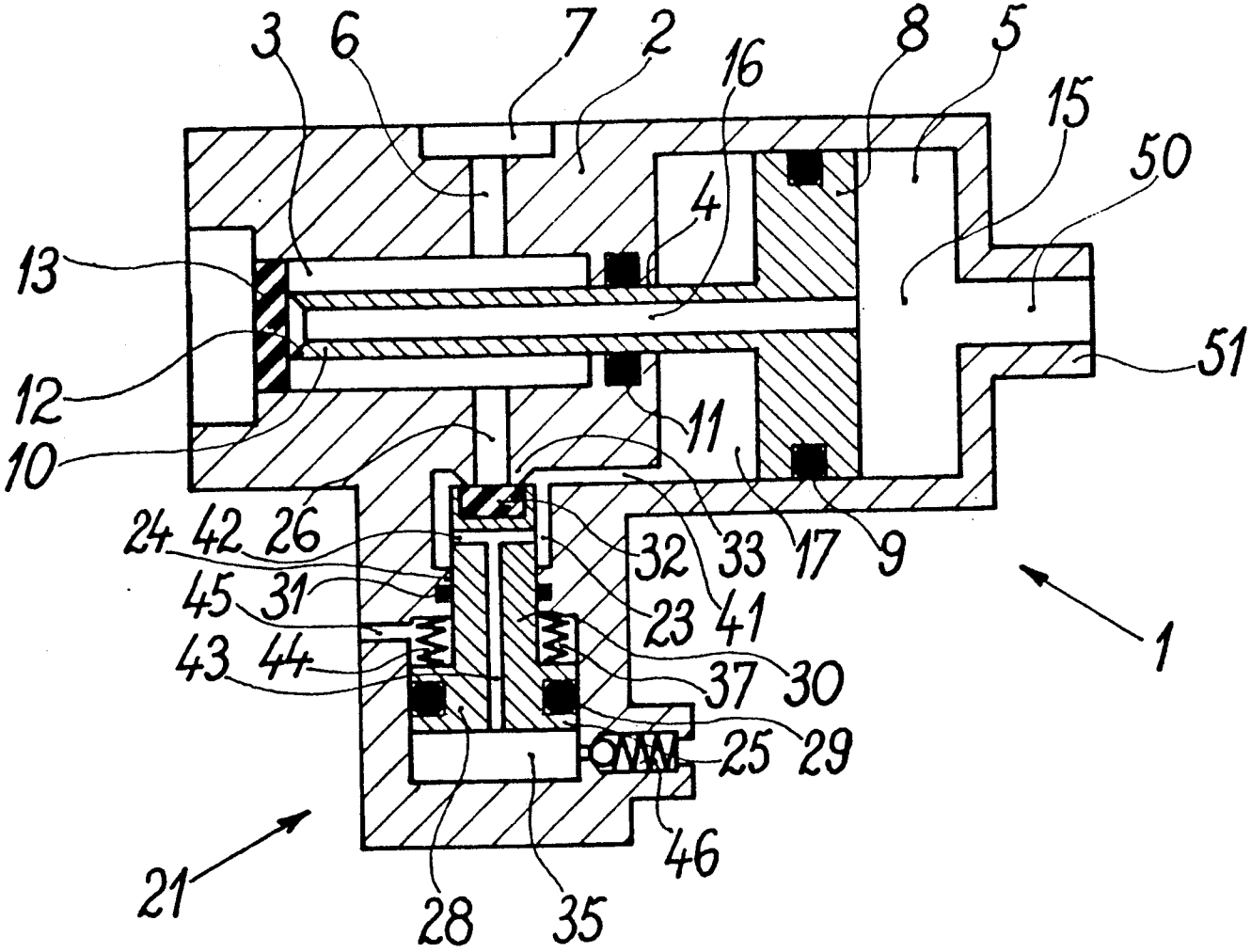
1
21
51
50
15
5
8
9
17
16
4
11
33
41
37
30
29
25
46
2
7
32
23
35
6
28
3
26
42
24
31
45
44
43
13
12
10

PROCESS AND EXPANDER FOR SUPPLYING RESPIRATORY GAS TO AN UNDERWATER DIVER

The invention relates to supplying respiratory gas to an underwater diver from a tank of respiratory gas compressed under high pressure carried by the diver.

It is known that in the supply techniques of this type for underwater divers, the respiratory gas is first subjected to a first expansion to medium pressure at the outlet of the tank, then the expanded gas is transferred to adjacent respiratory passages of the diver where it is subjected to a second expansion to low pressure, which is substantially equal to the ambient underwater pressure. Ordinarily, the first expansion is effected by displacement of an expansion valve secured to displacement means subjected on one active surface in the direction of closure of the valve to said expanded pressure and on the other active surface in the direction of opening of the valve to an elastic force associating the ambient underwater pressure. This elastic force is generally a loaded compression spring which is placed in the cylinder compartment associated with said active surface in the direction of opening of the valve, and this compartment communicates on the other hand freely with the underwater environment, such that the total pressure is the sum of the pressure exerted by the spring and the hydrostatic pressure of the ambient, which depends on the depth of submersion of the diver. Thus, if a drop in pressure takes place in the medium pressure compartment associated with the closure face of the piston, under the influence of a stronger inhalation, the displacement means tends to move in the opening direction, which correspondingly results in a supplemental admission of respiratory gas into the expander. However, this movement in the opening direction of the displacement means of the valve results in an elongation of the opposing spring, which tends to reduce the force exerted by this spring. In other words, a substantial drop in the medium pressure feeding the second expander stage cannot be totally counterbalanced by the displacement of the piston, with the result that there will then be a shortage of respiratory gas for the diver.

The object of the present invention is to ensure a flow of respiratory gas which will strictly conform to the required flow no matter what the depth of the diver and the intensity of the diver's breathing.

These objects of the invention are achieved, in an expander of the above type, in that the active elastic force in the opening direction of the valve is supplied by a charge of pressurized gas expanded at a medium regulating pressure from high pressure gas by an auxiliary pilot expansion valve secured to displacement means with an active surface in the closing direction of the auxiliary valve subjected to said medium control pressure and whose other active surface in the direction of opening of the auxiliary valve is subjected to the conjoint actions of a compression spring and the ambient underwater pressure, the gaseous charge at said medium control pressure communicating on its downstream side exclusively with a loaded discharge valve in the direction of the underwater ambient. This arrangement, which does away entirely with the compression spring acting on the principal expander for feeding respiratory gas to the diver and which replaces it with the action of a separate gaseous charge, without any fluctuation connected with the respiratory flow, permits maintaining a control pressure such that the respiratory flow is always that required by the diver. It should be noted that the pilot expander, whose control value is supplied by a spring, does not have in this connection any drawbacks connected with the distribution of a respiratory flow, because the gas under medium pressure which it delivers is confined in a reception region of the pilot gaseous charge, whose changes (pressure and volume) take place as a function of the depth of the diver and of the flow required by the second stage, respectively, the pressure of this gaseous charge of course increasing as the diver descends, while it is reduced when he rises, while the volume of said gaseous charge increases if the flow rate tends to increase and vice versa, the reduction of pressure and/or of volume of the gaseous charge taking place by direct discharge of a portion of the gaseous control charge toward the underwater ambient, via the loaded valve subjected on its downstream side to said ambient pressure, or toward the pressure means of the first expander in which case there is no air lost toward the exterior.

The invention also comprises a first stage medium pressure expander for underwater diving equipment, of the type comprising an expander valve housing cooperating with a valve seat defining an upstream passage terminating in a connector for a high pressure gas conduit and a downstream passage terminating in a connector for a medium pressure gas conduit leading to a second expansion stage under low pressure, said valve being secured to displacement means defining a first compartment communicating with said downstream passage under medium pressure, acting in the direction of closing of the valve and a second compartment located on the other side of said displacement means incorporating an elastic means pressing on the surface facing the displacement means, which is active in the direction of opening of the valve and this expander according to the invention is characterized in that the elastic means pressing on the opening surface of the displacement means of the expansion valve is a medium pressure gaseous control pressure supplied by an auxiliary pilot expander, of which one auxiliary high pressure inlet passage communicates freely with the high pressure passage of the principal expander and of which a medium control outlet pressure communicates freely with said second compartment of the principal expander acting in the opening direction of the valve and having a valve discharging toward the underwater environment.

In a preferred embodiment, the valve discharging toward the underwater environment for possible excess gaseous charge under medium control pressure, opens at the base of the cylinder compartment of the pilot expander, which acts in the closing direction of the pilot valve.

The characteristics and advantages of the invention will further appear from the description which follows with reference to the accompanying drawing which shows a cross section of an expander according to the invention.

A first stage expander 1 comprises a housing 2 with a high pressure chamber 3 separated by a constriction 4 from a cylinder chamber 5.

The elongated high pressure chamber 3 has a lateral passage 6 to a connector 7 for connection to the tank of gas under high pressure. In the cylinder chamber 5 is slidably disposed a piston 8 with a peripheral seal 9 secured to a rod 10 moving in the constriction 4 sealed by joint 11, and this rod 10 terminates at its free end in a valve 12 of the circular knife type adapted to bear against the flat wall of a valve seat 13.

Piston 8 divides cylinder chamber 5 into a compartment 15 for expanded pressure gas, which is passed through a through passage 16 of the piston rod 10 and of the piston 8, which tends to urge piston 8 in the closing direction of valve 12 on its seat 13, and a compartment 17 under gaseous pressure which acts in the opposite direction to urge piston 8 in the opening direction of valve 12 by moving away from its seat 13. This opening gas pressure of valve 12 is supplied by an auxiliary pilot expander 21 with an expansion chamber 23 separated by a constriction 24 from a cylinder chamber 25 all for the reception of a piston 28 sliding in the chamber 25 and sealed by a joint 29, and carrying a piston rod 30 passing through the constriction 24 sealed by a joint 31 and terminating in a cylindrical valve 32 coacting with a valve seat 33 of the circular knife type, which is formed on its upstream side with a high pressure conduit 26 communicating with the high pressure chamber 3 of the principal expander.

About the end of piston rod 30 is provided the expansion chamber 23 which communicates on the one hand via a passage 41 with the compartment 17 for opening the valve of the principal expander, and on the other hand via radial conduits 42 and an axial conduit 43 provided in the piston rod 30 with compartment 3 of the pilot expander acting in the direction of closing of the auxiliary valve 32, while the compartment 37 of the pilot expander contains a compression spring 44 acting in the direction of opening of the auxiliary valve and has a passage 45 for communication with the underwater environment.

The medium pressure respiratory gas for the diver escapes from the principal medium pressure expander by a passage 50 provided in the base of compartment 15 acting in the direction of the closing of valve 12 of the principal expander, this passage ending in a connector 51 connected by a flexible conduit to the second stage expander adjacent the inlet of the diver's nasal passages.

The operation of the first stage expander is as follows:

When the diver inhales, the medium pressure in compartment 15 falls, because of the loss of charge in the conduit communicating with the second stage expander, while the medium control pressure in the compartment 17 remains stable (if the diver remains at constant depth), the piston 8 of the principal expander moves in the direction of opening the valve 12 and if there is a strong inhalation, for example if the second stage expander remains permanently open, the displacement of the piston 8 is effected until it comes into contact with the bottom of compartment 15, such that the maximum flow rate is ensured to the first stage expander. This result is achieved with a medium pressure gaseous control charge in the compartment 17 acting toward the opening of the valve 12 and whose force is completely independent of the position of piston 8 of the principal expander. This gaseous control charge is supplied by the auxiliary pilot expander 21, so as to counterbalance the respiratory gas pressure under medium pressure acting on the piston 8 and the friction force from the joint 9.

If the respiratory demand falls, the medium pressure tends to rise in the compartment 15 because of the reduction of the loss of charge in the flexible conduit connecting the first and second stage expanders, which has the effect of pushing the piston 8 back in the direction of closing of the principal valve 12, which is ensured by the immediate discharge of a portion of the gaseous control charge, through a valve 46 which connects the base of compartment 35 of pilot expander 21 to the underwater environment.

It will be understood that the principal expander has an operation independent of the respiratory flow delivered to the diver. Moreover, it will be noted that the provision of an auxiliary pilot expander ensures that the mechanism of the principal expander will be sheltered from all contact with the ambient. It will be noted that the pilot expander may have a small size because the control flow which is all that it need furnish in case of increase of the respiratory breathing or the descent of the diver, is relatively small.

In the illustrated embodiment, the principal and auxiliary expanders are shown in the form of piston and cylinder expanders; but it is clear that the invention is applicable to any type of expander, for example comprising a membrane as a displaceable member.

The discharge valve has been shown with an outlet to the underwater environment. The invention also relates to the arrangement of the discharge valve which is adapted to empty toward the medium pressure side of the principal expander.

What is claimed is:

1. A first stage medium pressure expander for use in an underwater diving breathing apparatus comprising also a second stage expander and a source of pressurized gas, said first stage medium pressure expander including:

a housing defining a high pressure chamber connectable to a said source of pressurized gas, a medium pressure chamber, a control pressure chamber between said high pressure chamber and said medium pressure chamber, and a pilot expander;

a first valve and a first valve seat, said first valve coacting with said first valve seat, said first valve and said first valve seat being enclosed by said high pressure chamber;

an upstream passage extending from said high pressure chamber and cooperating with said first valve;

a high pressure conduit adapted to communicate between said high pressure chamber and a said source of pressurized gas;

a medium pressure conduit adapted to communicate between said medium-pressure chamber and a said second stage expander;

a first displacement means for activating said first valve, said first displacement means separating said medium pressure chamber from said control pressure chamber;

a control passage connecting said control pressure chamber with said pilot expander, said pilot expander being in fluid communication with said high pressure chamber, said pilot expander admitting pressure from said high pressure chamber into said control pressure chamber so as to urge said first displacement means to open said first valve;

said pilot expander further including an overpressure relief valve.

2. A first stage medium pressure expander as claimed in claim 1, wherein said housing further defines a first compartment in fluid communication with said control passage and a second compartment enclosing a spring member, and a first conduit portion communicating with said second compartment and opening outwardly from said housing, and wherein said pilot expander further includes a second valve and a second valve seat, said second valve coacting with said second valve seat, and second displacement means for activating said second valve, said second displacement means separating said first compartment from said second compartment, said spring urging said second displacement means to open said second valve.

3. A first stage medium pressure expander as claimed in claim 2, wherein at least one of said first and second displacement means includes a piston member slidingly received within said housing.

4. A first stage medium pressure expander as claimed in claim 2, wherein said overpressure relief valve is interposed in a conduit portion formed in the housing, communicating with said first compartment and opening outwardly.

* * * * *